US005855473A

United States Patent [19]

Liepert

[11] Patent Number: 5,855,473

[45] **Date of Patent: *Jan. 5, 1999**

[54] HIGH DISPLACEMENT RATE,SCROLL-TYPE, FLUID HANDLING APPARATUS

[75] Inventor: Anthony G. Liepert, Lincoln, Mass.

[73] Assignee: Varian Associates, Inc., Palo Alto, Calif.

[ * ] Notice: The term of this patent shall not extend beyond the expiration date of Pat. No. 5,616,015.

[21] Appl. No.: 800,909

[22] Filed: Feb. 13, 1997

Related U.S. Application Data

[63] Continuation-in-part of Ser. No. 484,145, Jun. 7, 1995, Pat. No. 5,616,015.

[51] Int. Cl.[6] ..... F04C 18/04; F04C 23/00; F04C 25/02

[52] U.S. Cl. ..... 418/5; 418/55.2; 418/55.3; 418/60

[58] Field of Search ..... 418/5, 55.2, 55.3, 418/60

[56] References Cited

U.S. PATENT DOCUMENTS

| | | | |
|---|---|---|---|
| 3,989,422 | 11/1976 | Guttinger | 418/55.2 |
| 4,650,405 | 3/1987 | Iwanami et al. | 418/5 |
| 5,258,046 | 11/1993 | Haga et al. | 418/55.2 |
| 5,616,015 | 4/1997 | Liepert | 418/5 |

FOREIGN PATENT DOCUMENTS

| | | | |
|---|---|---|---|
| 57-28890 | 2/1982 | Japan | 418/55.2 |
| 63-1782 | 1/1988 | Japan | 418/55.2 |
| 2-140484 | 5/1990 | Japan | 418/55.2 |

*Primary Examiner*—John J. Vrablik
*Attorney, Agent, or Firm*—Bella Fishman; Peter J. Manus

[57] ABSTRACT

A fluid handling apparatus, particularly a vacuum pump, has as a first stage a high volumetric displacement rate scroll pump of multiple nested interacting pairs of fixed and movable spiral-shaped blades supported in a housing between an inlet and an outlet. Each adjacent blade pair closes one inter-blade pocket in each cycle of operation. For very low base pressure vacuum applications, the adjacent blades extend about two revolutions to produce plural pockets in series. A second scroll pump mounted in the housing has its inlet fed directly from the first scroll outlet. The second scroll has a single pair of co-acting fixed and movable blades with multiple revolutions. A central drive shaft rotating in main bearings has an eccentric portion coupled to a plate that carries the movable blades of both scroll pumps. Synchronization cranks constrain the plate to orbit, not rotate. A purge gas flows over the crank bearings to sweep away and/or dilute corrosive fluids. It exhausts within the pump to the inter-stage pressure at the second stage inlet without adversely affecting the pump inlet pressure. Another purge gas flow sweeps corrosive gases from the main bearings, preferably formed as two sets of angular contact ball bearings aligned axially and oriented back-to-back.

7 Claims, 7 Drawing Sheets

HIGH DISPLACEMENT RATE,SCROLL-TYPE, FLUID HANDLING APPARATUS

REFERENCE TO RELATED APPLICATIONS

This application is a continuation-in-part of applicant's U.S. Ser. No. 08/484,145 filed Jun. 7, 1995, U.S. Pat. No. 5,616,015.

BACKGROUND OF THE INVENTION

This invention relates in general to fluid handling apparatus, and in particular to a dry, scroll-type, two-stage, positive displacement, vacuum pump useful in general roughing pump applications.

The general operating principles of scroll pumps are described in 1905 U.S. Pat. No. 801,182 to Creux. A movable spiral blade (sometimes termed a "wrap" or "wall") orbits with respect to a fixed spiral blade within a housing. The configuration of the blades and their relative motion traps one or more volumes or "pockets" of a fluid between the blades and moves the fluid through the pump. Creux describes using the energy of steam to drive the blades to produce a rotary power output. Most applications, however, apply a rotary power to pump a fluid through the device. Oil lubricated scroll pumps are widely used as refrigerant compressors. Other applications include expanders (operating in reverse from a compressor), and vacuum pumps. To date, scroll-type pumps have not been widely adopted for use as vacuum pumps.

Scroll pumps must satisfy a number of often competing design objectives. Blades must be configured to interact with each other so that their relative motion defines the pockets that transport, and often compress, the fluid held in the pockets. The blades must therefore move relative to each other, yet also seal. In vacuum pumping, the vacuum level achievable by the pump is often limited by the tendency of high pressure gas at the outlet to flow backwards toward the lower pressure inlet region. The effectiveness and durability of the blade seals, both tip seals along their spiral edges and clearance seals between fixed and movable blades, are important determinants of performance and reliability.

Friction in the drive, blade motion, and seals, as well as the compression of the working fluid, produce wear and heat. It is necessary to cool the apparatus. A wide variety of techniques are known. They include air cooling, flows of refrigerants, and flows or sprays of a lubricant which acts as a heat sink and transfer medium as well as a lubricant. Oil lubrication is the most common technique. Lubrication can also aid in sealing the movable component acting on the working fluid. However, when oil or other lubricants are used in vacuum pumps, as the pressure falls to low levels, the vapor pressure of the lubricant itself contributes lubricant to the gas which, to some degree, offsets the action of the pump. Vaporized lubricant can also flow back into the system being evacuated to contaminate the system with molecules of the lubricant.

Further, in vacuum pumping it is desirable to have a high volumetric displacement rate of gas from the vacuum region, e.g., to pump out quickly a mass spectrometer or a compartment of a machine where semiconductor devices are fabricated. In general, scroll designs for vacuum pumping produce little or no compression. But scroll pumps solely optimized for high displacement rates are often not well suited for operating across a large pressure differential, e.g., between a few milliTorr at the inlet and atmosphere, 760 Torr, at the outlet, and vice versa. To support a large pressure differential, it is known to use a blade pair with multiple revolutions which produce multiple blade surface-to-blade surface clearance seals that block a back flow of the fluid from the high pressure at the outlet. However, the through put, or displacement capacity, of such a pump is limited.

A seemingly straightforward solution to increasing displacement is to increase the maximum inter-blade spacing so each pocket has a larger volume. For a constant scroll wall thickness this spacing is set by the crank radius. Therefore displacement can, in theory, be increased merely by increasing the crank radius. However, a larger radius has various disadvantages such as an increase in seal velocity and attendant wear, an increase in the radial forces acting on the crank, and an increase in steady state power consumption which relates to seal velocity and friction. A larger crank radius also increases the diameter of the plate and therefore the overall dimensions of the pump. Also, for a given plate diameter, a large crank radius results in fewer revolutions, fewer clearance seals in series and, therefore, more back leakage. The seemingly simple solution of increasing the crank radius is therefore contraindicated by size, wear, and frictional heating considerations.

To increase pump capacity, it is also known to operate multiple scrolls in parallel as done by Iwata Air Compressor Corporation in its model ISP-500 dry scroll vacuum pump. This is a single stage roughing pump using two parallel, back-to-back scroll sets that each have blades with an angular extent of more than four revolutions. While this pump has a displacement rate of 20 cubic feet per minute (CFM) at its inlet, its pumping speed drops off markedly below 100 milliTorr, presumably due to back leakage through the pump from its outlet to its inlet. This is a quite significant problem in some applications, e.g., in some helium leak detectors, where the roughing pump inlet pressure must reach less than 20 milliTorr before the leak test can begin. Another problem is that this pump can achieve a base pressure of only 5 milliTorr, whereas, by way of comparison, a commercial two stage rotary, oil-lubricated roughing pump can produce base pressures of 0.5 milliTorr. Yet another problem is that this model Iwata pump uses about 20 feet of tip seal material. Wear of this amount of tip seal produces significant debris which can contaminate the system being evacuated. This amount of sealing material also adversely affects power requirements.

U.S. Pat. No. 3,802,809 to Vulliez discloses a two stage, scroll-type vacuum pump. The device is cooled, but not lubricated, by recirculating, pumped oil. This vacuum pump has an internal bellows and internal oil-carrying passages to isolate the scroll surfaces open to the working fluid from the oil cooling circuit. A drive at one off-center eccentric bearing propels a movable plate or plates. A two stage embodiment is shown, but it uses two movable plates. While Vulliez uses two stages with a nested first stage, the volumetric displacement rates of the stages are required to be equal (column 9, line 54). This arrangement limits the effective volumetric displacement rate attainable by the pump as a combined two stage unit. An in-built electric fan is disclosed as a possible cooling device, but it is auxiliary to the oil cooling circuit.

One recent scroll pump design combines scroll pumps in series to achieve improved operating results. For example, U.S. Pat. No. 5,304,047 to Shibamoto discloses a two stage, scroll-type, oil-lubricated refrigerant compressor. Shibamoto radially separates the inlet of the second stage from the outlet of the first stage. While Shibamoto discloses a two-stage pump, it is not suited for operation as a vacuum pump because it requires a dynamic, oil-lubricated seal at the outer edge of the orbiting second stage scroll to control back leakage of the gas. Also, oil coolant and lubricant is injected onto the moving parts in low and intermediate pressure zones, collected, and recirculated.

For extremely low pressure applications such as evacuating a spectrometer tube used in helium leak detectors, known scroll pumps are not operated alone. It is conventional to use a turbo pump in series with the scroll pump. This combination of pumps, scroll and turbo pumps, can produce the desired pressure levels in a commercially acceptable period of time, but this solution is expensive since a turbo pump typically costs several thousand U.S. dollars.

Still another design problem is how to synchronize the movement of the movable blades to produce the orbital motion while at the same time 1) resisting the substantial axial forces produced by the large pressure differentials within the pump, 2) avoiding contamination of the vessel being evacuated by lubricants or wear debris, and 3) avoiding corrosion of bearings within the pump by condensed water, water vapor or corrosive gases such as those used in semiconductor processing.

It is known to use idler cranks mounted between a housing and an orbiting plate. While known cranks are sturdy and comparatively inexpensive, they are not readily protected from corrosive process gases and they are not well-suited to bear a substantial axial load.

It is also known to use a purge gas, e.g., a flow of a dried inert gas such as nitrogen, to carry away and/or dilute corrosive gases and fluids that could attack the bearings. Water will corrode 52100 bearing steel commonly used for bearing races and balls. Ceramic balls and races avoid the problems but they are very costly and more susceptible to destruction when subjected to mechanical shocks or when they wear. A stainless steel such as type 440C is more tolerant of water, but the "aggressive" gases commonly used in semiconductor processing will attack it, as well as 52100 steel.

However, the implementation of purge gas flows in vacuum scroll pumps has been difficult. Heretofore purge gas flows been used mainly in connection with pumps other than scroll pumps, such as screw pumps, roots pumps, and claw pumps. For example, the commercial Iwata ISP series scroll pumps use idler cranks. They operate in a region that is at the pump intake pressure. If one were to flush these idlers with a purge gas, the pump would have to evacuate the purge gas as well as the gas in the system being evacuated. To adequately protect the idler cranks, the purge gas would thus significantly raise the pump inlet pressure.

It is also known to use elastomeric seals to block contaminants and corrosive gases from bearings and to hold lubricants against escape to the regions being pumped. Such seals are particularly common as shaft seals on main crankshaft bearings. The problem is that hot water or water vapor and corrosive gases leak under the seals over time due to pressure differentials that arise within the pump in its ordinary operation. These differentials are due to thermal transients and to changes in the pump inlet pressure, e.g., when a chamber to be evacuated is at atmospheric pressure and it is valved to an operating pump. Thermal transients are produced whenever the pump warms or cools. The gas pressure in trapped spaces around the bearings will rise or fall. Over time, the pressure differential across the seal equilibriates, causing a mass transport past the seal which can include water, water vapor or other corrosive gases.

It is therefore a principal object of this invention to provide a positive displacement, scroll-type, fluid handling device that has a high volumetric displacement rate at the inlet and which, when used as a vacuum pump, operates steady state between a milliTorr vacuum and atmosphere with a good control over fluid back leakage and with a purge gas flow over its bearings.

Another principal object of this invention is to provide these advantages while at the same time controlling bearing corrosion and lubricant leakage.

Another object is to provide a fluid handling device with the foregoing advantages that can operate with conventional idler cranks to provide synchronization.

A further object is to provide a fluid handling device with the foregoing advantages operated as a vacuum pump which can produce ultimate base pressures suitable for use in extremely low pressure applications such as directly evacuating the spectrometer tube in a helium leak detector.

Still another object is to provide a fluid handling apparatus with the foregoing advantages which uses only air cooling.

Another object is to provide a fluid handling device with the foregoing advantages that has a comparatively low cost of manufacture and good durability.

SUMMARY OF THE INVENTION

A dry, scroll-type, fluid handling apparatus such as a gas vacuum pump has a first stage scroll pump formed by at least two nested pairs of interacting fixed and movable scroll blades mounted in a housing between a fluid inlet and a fluid outlet. An eccentric drive propels the movable blades in an orbital motion, preferably via a generally circular plate with an eccentric drive at its center and with a comparatively small crank radius. A set of cranks, preferably equiangularly spaced needle and ball bearing assemblies, are located between the plate and the housing to synchronize the orbital motion. A main bearing set rotatably supports a central drive shaft, with an eccentric offset by a distance r and rotatably coupled to the circular plate. Preferably the main bearings are a stacked pair of angular contact, ball bearing assemblies set in a "back-to-back" orientation to resist both axial loads and tilting moments applied to the drive shaft.

In each cycle of operation each co-acting blade pair is open to the vacuum inlet during a portion of the cycle, and closed to the inlet during a subsequent portion of the cycle, at which time this pair is open to the outlet. The blades each extend angularly for a sufficient angular distance, preferably about 360°, to close a pocket in each cycle of operation. This closing and opening in each cycle produces substantially no internal compression of the gas being transported. In a preferred form for vacuum pumping, the outlet from the first stage high-displacement rate scroll pump communicates directly and immediately with the inlet of a second stage scroll pump discharging to atmospheric pressure at the housing outlet. The first stage outlet and second stage inlet are preferably adjacent one another at their outer peripheries. The first stage scroll set uses three nested blade pairs with an inlet at the center of the scroll.

For extremely low pressure vacuum applications such as helium leak detection, the first stage blade pairs each preferably extend just over two revolutions to produce two pockets of transported gas in series with a blade-to-blade moving clearance seal between the pockets. Two revolutions of the pump are required to transport each pocket from the pump inlet to the inlet to the second stage. Preferably the number of nested blade pairs is reduced to two and the crank radius is also reduced, by about ⅓. This embodiment sacrifices displacement rate for improved back-flow control.

The second scroll set uses a single pair of blades, but with multiple spiral turns to convey multiple volumes or pockets of gas along the flow path defined by the blades, each separated from adjacent pockets by a moving clearance seal. The second stage outlet is near the center of the spiral blades. The volumetric displacement rate of the first scroll set exceeds that of the second scroll set. To better control back leakage of gas from the high pressure discharge port, the axial height of the second scroll set blades is kept short, typically less the axial height of the first stage scroll blades. The crank radius is preferably less than twice the thickness of one of the second stage blades.

The synchronization crank bearings are protected against corrosion by flows of a purge gas that is discharged to the inter-stage region of the pump which has a low pressure during operation, typically about 100 milliTorr. At this pressure, water will not condense and a low flow rate, e.g., 0.01 to 1.0 liters per minute (lpm), is sufficient to sweep corrosive gases away from the bearings. The bearings can be sealed, unsealed or have only shields.

An air fan, preferably one secured on the central drive shaft, cools the fluid handling device. Fins, preferably radial arrays of fins on both inboard and outboard housing faces, enhance heat conduction to a cooling air stream. An air passage or passages directs fan-driven air from an inboard face adjacent the fan to the fins on the outboard face.

These and other features and objects of the invention will be better understood from the following detailed description which should be read in light of the accompanying drawings.

DETAILED DESCRIPTION OF THE PREFERRED EMBODIMENTS

FIGS. 1–7 show a positive displacement fluid handling device 10 according to the present invention. More particularly, the invention will be described with respect to a preferred embodiment, namely, a dry, two stage, vacuum pump 10. The fluid is a gas, typically air, evacuated from a system, e.g. a container or equipment (not shown), that is connected to a vacuum inlet 12 of the pump. The pump 10 is particularly useful as a roughing pump for semiconductor processing. In such applications, the pump will also remove, and be subjected to, corrosive gases used in this processing.

Figure 2:
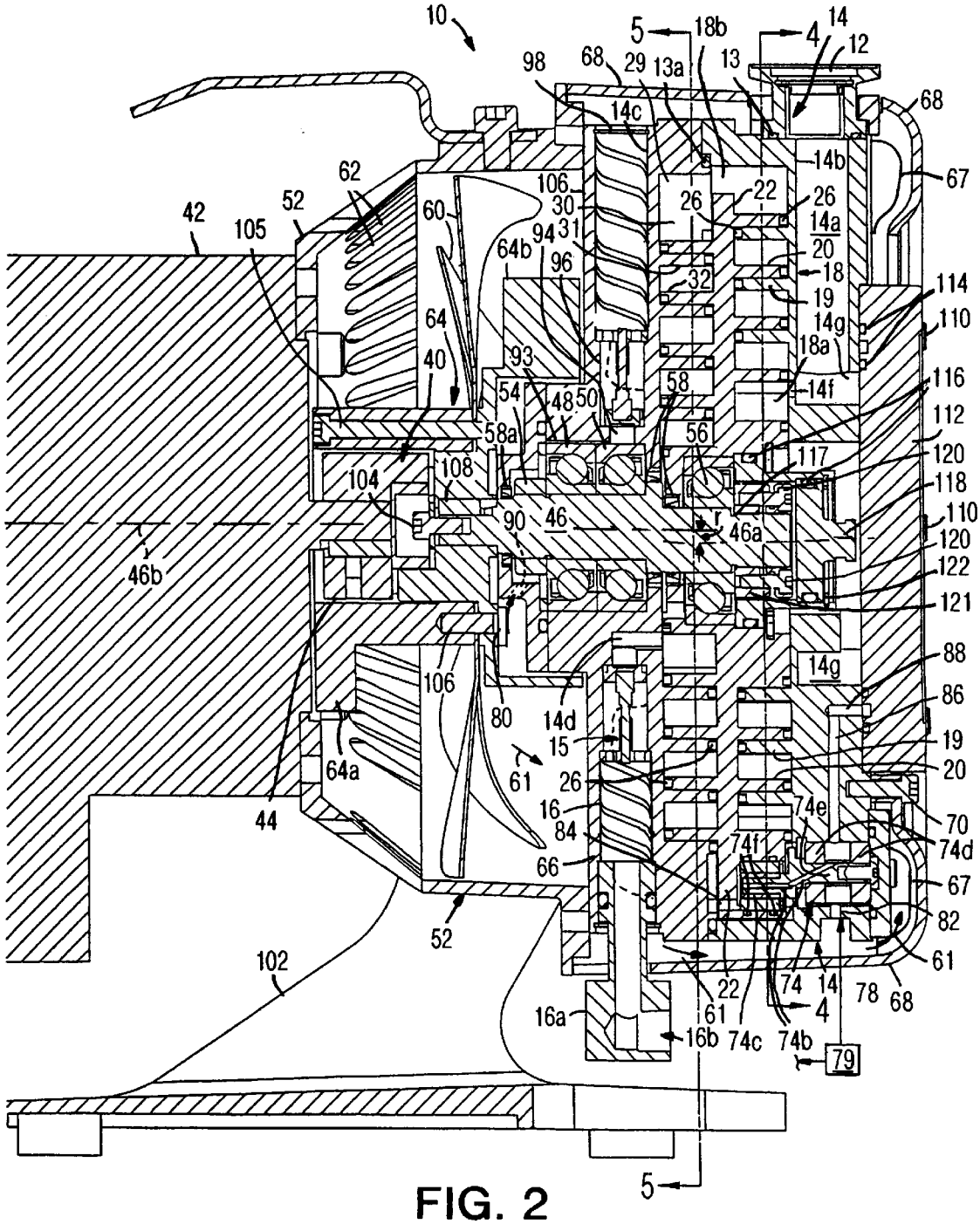
FIG. 2 is a view in section of the pump shown in FIG. 1 taken along the line 2—2.

As shown in FIG. 2, an o-ring 13 seals the inlet 12 over a radially directed inlet port 14*a* in a housing 14 that feeds an intake flow via a C-shaped header 14*g* to three inlet ports 14*f* arranged on a circle around and near the center of the housing. The housing 14 is formed by two hollow "halves". Housing portion 14*b* encloses and in part defines a stage I, high displacement pump; housing portion 14*c* encloses and in part defines a stage II low back leakage pump. O-ring 13*a* seals the housing portions 14*b* and 14*c* to one another, respectively. An outlet port 14*d* is formed in the stage II housing near its center. It communicates via a spring-biased check valve 15 with a radially-directed, high-pressure discharge passage 16 drilled in the housing portion 14*c* and venting to atmosphere at the outer periphery of the housing via an exhaust assembly 16*a* with a threaded outlet port 16*b*. The exhaust assembly 16*a* is located at the bottom of the pump when it is installed to drain water that condenses in the pump 10.

Figure 4:
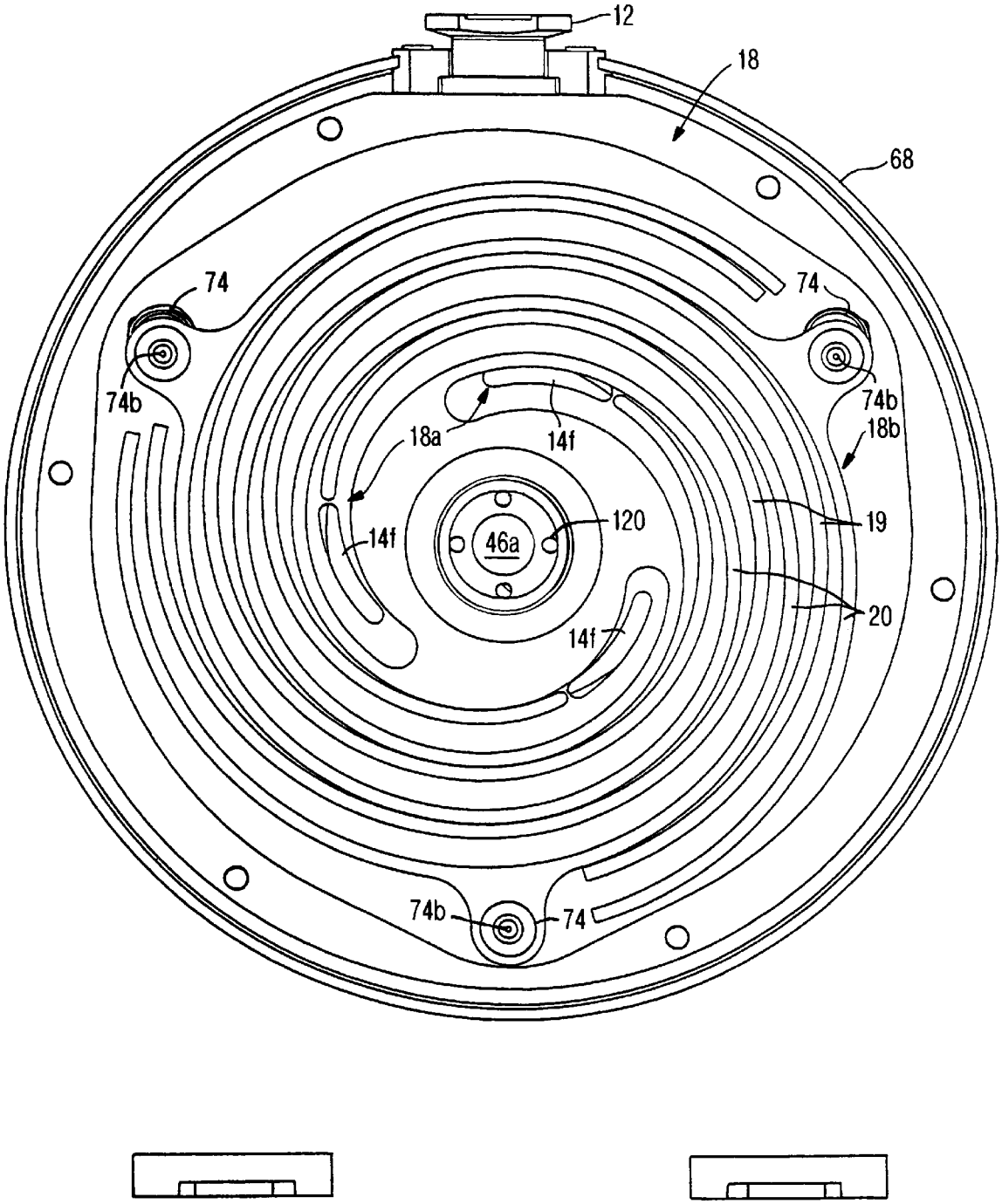
FIG. 4 is a sectional view of the first stage scroll set shown in FIG. 2 and taken along line 4—4 in FIG. 2.

A first stage scroll pump 18 is mounted within the housing with its inlet region 18*a* in fluid communication with the inlet port 14*a* and vacuum inlet 12 via the header 14*g* and three of the inlet ports 14*f* (FIGS. 2 and 4). It is a high volumetric displacement rate pump. As is best seen in FIG. 4, the scroll pump 18 is formed by three pairs of nested, spiral-shaped blades (or wraps). Each blade pair includes a stationary blade 19, and an orbiting blade 20. The blades 19 are preferably formed integrally with the housing portion 14*b* to facilitate heat transfer and to increase the mechanical rigidity and durability of the pump. The blades 20 in turn are preferably formed integrally with a movable plate 22 for the same reasons. The blades 19 and 20 extend axially toward one another and "interleaf" as shown in FIG. 4. A clockwise orbital motion of the plate 22 and the blades 20 produces a characteristic scroll-type pumping action of the gas entering the scroll set from the ports 14*f* at the inlet region 18*a*.

Figure 7:
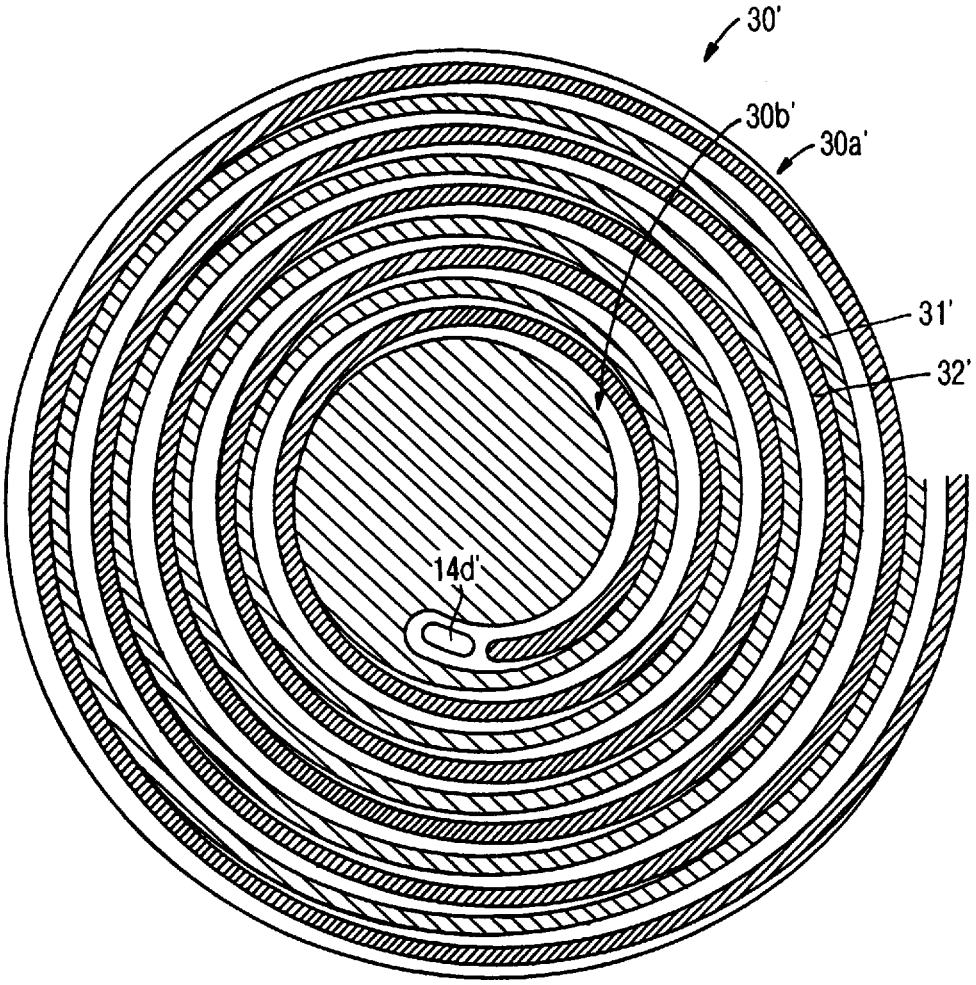

The free edge of each blade 19 and 20 carries a continuous tip seal 26 of a low-friction, wear resistant, elastomerically energized material such as the seal described with respect to FIG. 7 of U.S. Pat. No. 3,994,636 to McCullough et al. This seal 26 preferably has an outer layer of a Teflon®-based compound with an underlying resilient material that urges the outer layer into a sealing relationship. Each blade 19 and 20 extends axially toward the plate 22 and housing portion 14*b*, respectively, so that there is a light sliding seal at the edge of each blade.

In an alternate form of this invention the tip seals 26 may be omitted, but with this form it is difficult to pump to a base pressure less than about 20 millTorr. There is then a slight clearance between the free edges of the blades and the facing surfaces.

Gas exits the scroll pump 18 at its outer periphery 18*b* where it flows around the outer periphery of the plate 22, via an annular region 29, to an annular inlet region 30*a* of a second stage scroll pump 30. The second stage pump 30 transports the gas from the first stage pump 18. At steady state operation the pump 30 receives gas at some intermediate pressure, a typical value being about 100 milliTorr, and discharges it via port 14*d* to atmosphere, about 760 Torr. It is essential that the pump 30 control backward leakage of gas from an outlet region 30*b* near its center towards the inlet region 30*a* at its outer periphery. In each cycle of operation, gas at atmospheric pressure back fills an innermost pocket, and is then squeezed out as the pocket closes.

In its presently preferred form the second stage pump 30 has a single pair of stationary and moving blades 31 and 32, respectively, that spiral in multiple revolutions, about four as shown, for a total angular distance of about 1440°. Volumes or lunette-shaped pockets P of working gas entrained in this scroll set are transported in successive cycles of operation as they travel through the pump, here, radially inward along an involute path. The gas pockets are also compressed to some extent since the volume of the pockets decreases as they proceed from the inlet to the outlet. The resulting internal pressure increase within the second stage pump is, however, negligible when compared to the pressure differential between the inlet and the outlet. The pump 30 acts principally through mass transport, not compression. Note that as the radially innermost pocket opens to the outlet it will fill with atmospheric (outlet) pressure gas. Continued orbiting propels this volume of high pressure gas to the outlet and then closes at the outlet in each cycle of operation.

To control back leakage it is significant that the axial height of the blades 31, 32 be comparatively low. As shown, and presently preferred, the axial height is about 95% that of the first stage blades 19, 20. The blades 31, 32 each carry a continuous low friction, wear-resistant tip seal 26 on their free edge. As in the pump 18, the tip seal establishes a sliding seal between the blades and the plate and the opposite housing portion, here 14*c*. As is well known, the blades 31 and 32 operate with a slight clearance between their opposing surfaces at the point of their closest approach. There should be no actual contact. This clearance is sufficient to substantially contain the gas in the pockets, but avoids blade-to-blade friction, wear and heating. A low axial height reduces the cross-sectional area available as a leak path in the clearance seal.

The precise value for the height cannot be calculated directly with accuracy; it is determined empirically knowing that the displacement rate is linearly proportional to the axial height of the scroll blades and that leakage is a complex function of clearances and angular alignment between the scroll blades, blade height, leakage across the tip seals, and instantaneous pressures and flow regimes within individual scroll pockets. For a given scroll pump, the desired value for the axial height will also depend, of course, on the overall size of the pump, its desired operating characteristics, and the blade clearance, both new and after use-induced wear. The ultimate controlling design factor for the axial height is whether back leakage is controlled adequately to maintain the desired ultimate base pressure in the evacuated system.

It is also a significant aspect of this invention that the volumetric displacement rate of the first stage pump 18 exceeds that of the second stage pump 30. Stated in other words, one aspect of the present invention is that the functions of the stages are separated, optimized, and nevertheless combined in series. The first stage I is optimized for volumetric displacement, which is higher than that of any known two-stage, scroll-type vacuum pump; the second stage is optimized to control back leakage, albeit with a smaller volumetric displacement than the first stage.

Figure 1:
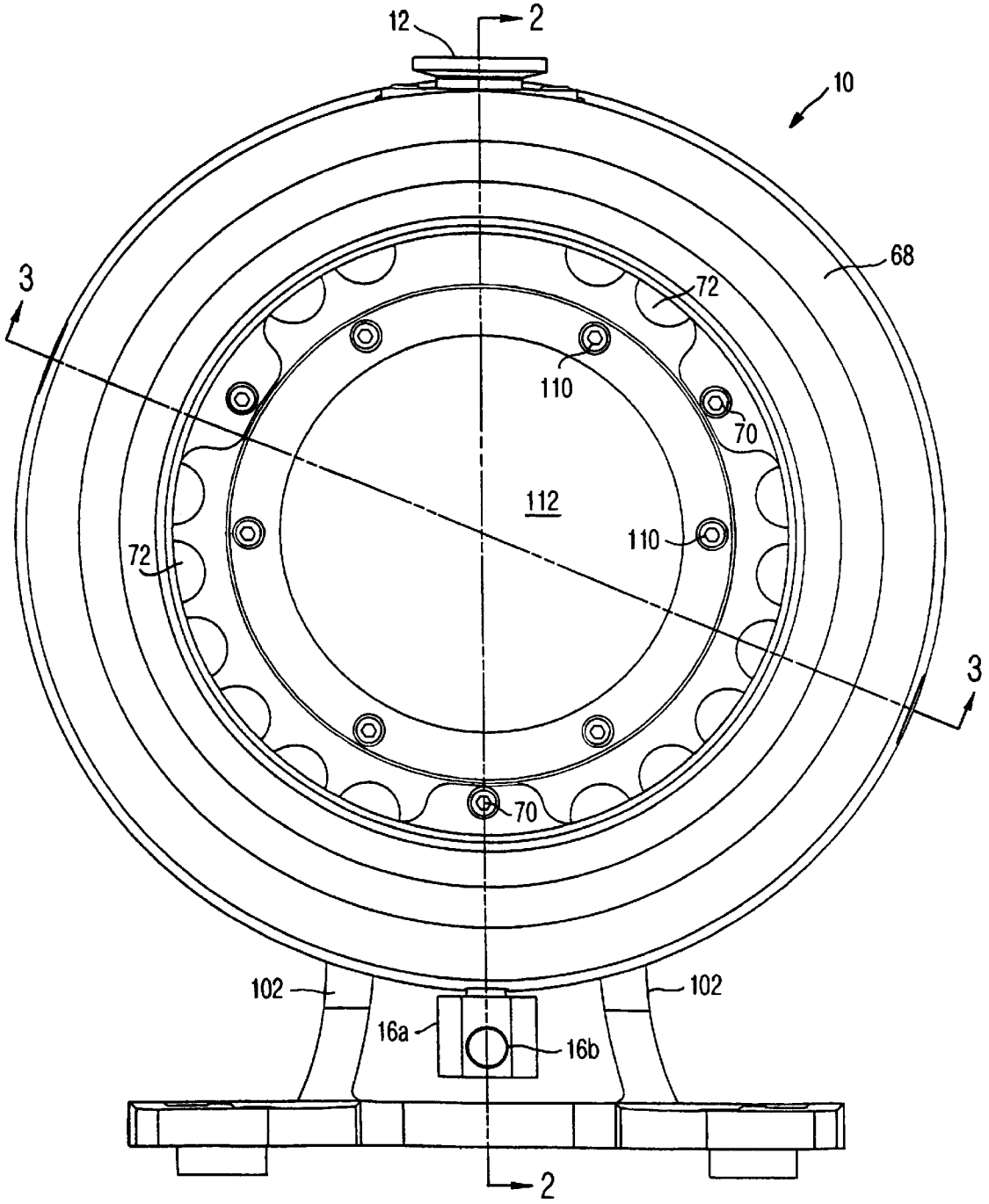
FIG. 1 is a view in front elevation of a positive displacement, two stage, dry, scroll-type vacuum pump constructed according to the present invention.
Figure 3:
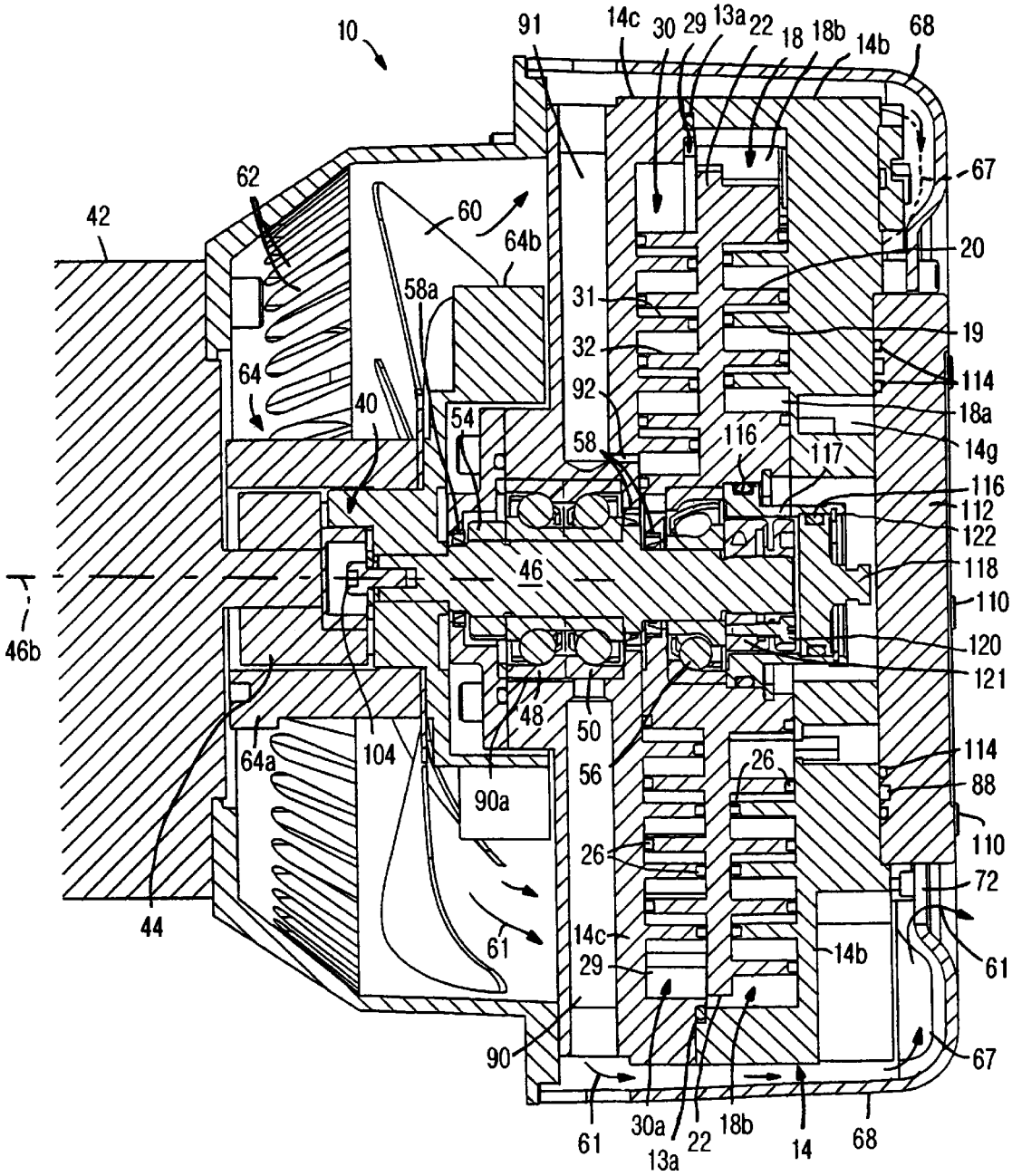
FIG. 3 is a view in section and taken along the line 3—3 in FIG. 1.

FIGS. 2 and 3 show the blades 19, 20 at a 6 o'clock position during a cycle of operation at two different angular cross-sectional views as shown in FIG. 1. FIG. 4 also shows the blades in the FIG. 2 (6 o'clock) orbital position. FIGS. 2–4 show a nest of three pairs of movable and stationary blades. In FIG. 2, three inlets 14*f* are each at least partially open to an associated one of the blade pairs. In FIG. 4, continued clockwise orbital, not rotational, motion of the movable blades 20 causes the blades 20 to move with respect to the stationary blades 19, so as to enclose and transport lunette-shaped pockets P of gas from the regions 18*a* to the region 18*b*. Gas from the annular region 29 at some intermediate pressure backfills the pockets open to the region 18*b*. However, mass flow back to the inlet region 18*a* is substantially prevented by continual near contact of blades 19 and 20. Continued orbiting of blade 20 forces substantially all the gas in the pockets out into the annular region 29 as the volume of pockets are successively reduced to near zero. Because this is a three-nested array, corresponding pocket openings and closings will occur inside and outside each stationary blade 19, albeit at different times in each cycle of operation.

For each complete orbit of the movable blades 20, a total of six pockets (two for each blade pair) are sequentially closed at the scroll inner ends. As the movable blade set continues to orbit clockwise, as shown in FIG. 4, each trapped pocket is sequentially opened to the outlet 18*b*. Further orbiting movement results in the reduction of the volume of each pocket to near zero, thereby completing one orbit of the movable plate. As in all scroll pumps, this orbital interaction of the blades also propels the working fluid through the scroll set. But with the scroll configuration of FIGS. 2–4, there is substantially no compression of the fluid internal to the scroll set. As the inlet to an inter-blade space closes, a pocket adjacent the outlet region 18*b* and located approximately 360° ahead of the inlet opens. Further blade actions moves the fluid in the space (pocket) to the outlet region 18*b*, but because the fluid is almost immediately in direct fluid communication with the outlet, there is a negligible increase in fluid pressure due to compression. This type of device is commonly referred to as a positive displacement pump. Fluid at the exhaust pressure rushes in, pressurizing the pocket to that pressure.

Because of the design and nesting of blades, and the resulting comparatively large percentage of the interior volume of the pump 18 that is filled at any moment in the cycle of operation by the fluid, the volumetric displacement rate of the pump 18 is high, particularly for a dry scroll pump. For a given pump size, operated under the same conditions, the volumetric displacement rate is calculated to be about two times the best rate heretofore achievable with dry scroll pumps.

Figure 5:
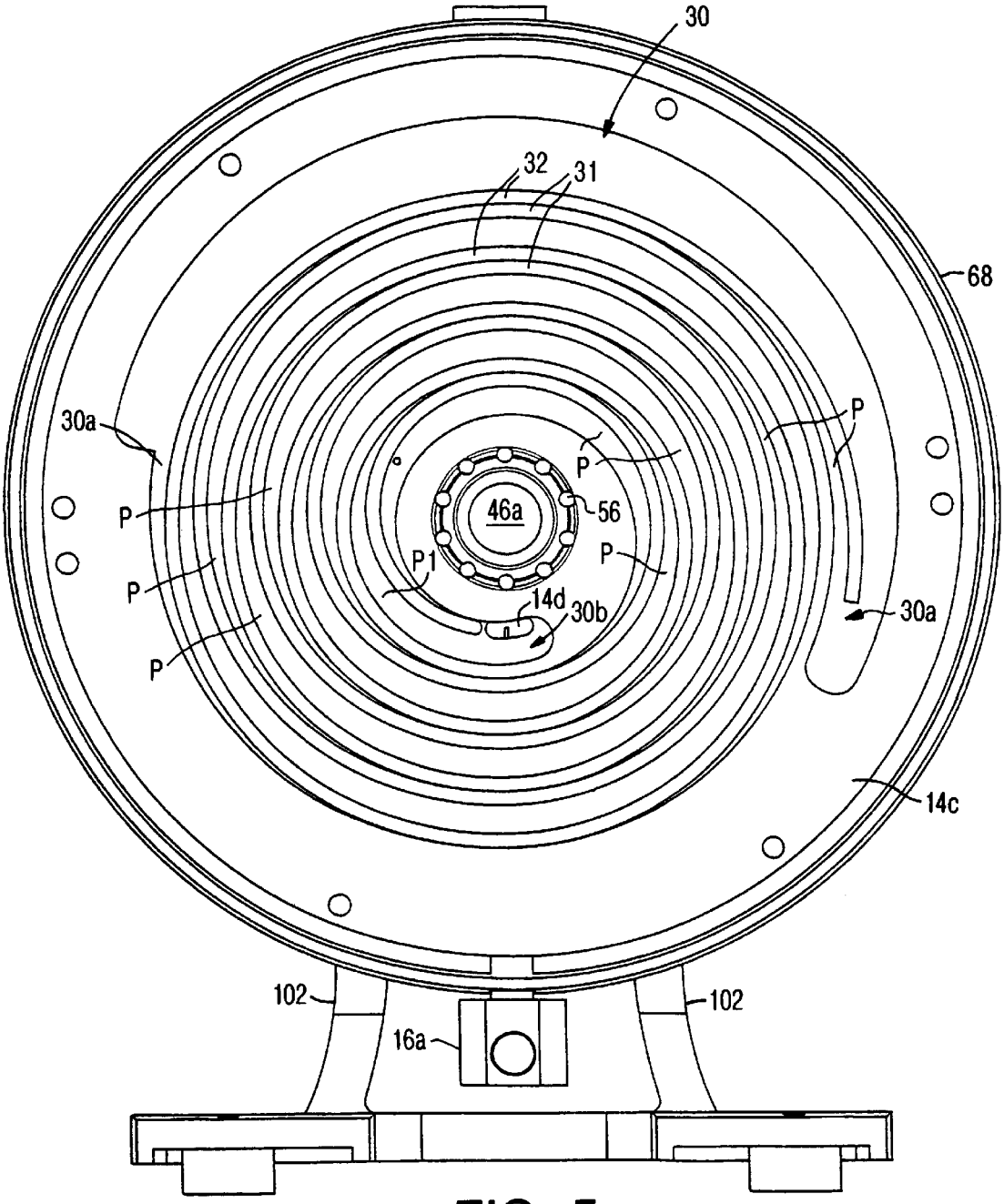
FIG. 5 is a sectional view of the second stage scroll set shown in FIG. 2 and taken along line 5—5 in FIG. 2.

FIG. 5 shows the single pair, multiple revolution scroll set of the second stage pump 30. The fluid inlet region 30*a* extends in an annular band around the outer periphery of the pump 30. The fluid enters and is enclosed in two pockets. Because the pump 30 has its movable blade 32 mounted on the opposite side of the plate 22 from the movable blade 20, the direction of orbiting is counter clockwise as shown. The orbit radius is, of course, again r. Successive orbits of the blade 32 in successive cycles of operation causes the enclosed masses of gas to travel radially inwardly through the scroll. As noted above, there is some compression since the volume in the pockets decreases, but the degree of this compression is negligible when compared to the pressure differential supported across the pump 30. The radially innermost pocket P1 backfills with exhaust pressure gas which is squeezed out again as continued orbiting of the scroll set reduces the volume of this pocket and then closes it. The many turns of the scroll blades of this pump creates a long leak path with multiple clearance seals spaced serially along the involute path. As shown, the pump 30 uses a single fixed blade and a single orbiting blade, each with an angular extent of about four 360° spiral turns.

Referring again to FIGS. 1–3, a drive 40 for the pumps 18 and 30 is powered by an electric motor 42 connected by a rubber spider coupling 44 to a drive shaft 46 mounted in a pair of axially aligned main bearings assemblies 48, 50. These bearings are preferably angular contact ball bearing assemblies such as Fafnir type 7304WN. The bearings are lubricated with a low vapor pressure grease such as DuPont Krytox 240AC brand. When property mounted, this type of bearing assembly resists both axial and radial loads. A pair of such assemblies are oriented in a back-to-back relationship, as shown, to resist not only the substantial axial load produced by the large pressure differential acting on the opposite faces of orbiting plate 22, but also to resist tilting moments applied to the drive shaft 46. Bearings 48 & 50 are rigidly supported in housing 14*c* by a thermal shrink fit. A jam nut 54 secures the bearings 48, 50 to the drive shaft 46.

The shaft 46 has an eccentric end portion 46*a* at an eccentric radius r (FIG. 2) with respect to the axis of rotation 46*b* of the rest of the shaft 46 and the motor 42. Another angular contact, grease-loaded, ball bearing assembly 56, similar to bearing 48 or 50, secured on the end 46*a* of the drive shaft 46, connects to the plate 22 in a central plate opening. Rotation of the shaft 46 by the motor 42 thus causes the center of the plate 22 to move in a circular path with a radius r. In the preferred embodiment of the invention, built in the dimensions given below as illustrative, bearing 56 supports an axial load of about 300 pounds and a radial load of about 50 pounds.

Shaft seals 58 keep process gas and contaminants from entering the bearings 48, 50 and 56. Shaft seal 58*a* isolates the pump internal mechanisms from the atmosphere. Shaft seals 58 and 58*a* are standard, commercially available seals molded, for example, from Viton or Buna N.

A fan 60 secured on the drive shaft in a housing 52 produces a flow 61 of cooling air through slots 62 in the housing 52 onto the outer surface of the housing portion 14*c*. A counterweight assembly 64 that includes a "motor" counterweight 64*a* and a "main" counterweight 64*b* is formed integrally with, or secured to, the fan 60 in order to statically and dynamically balance the mass of the plate 22 which orbits eccentrically with respect to the axis of rotation 46*b* of the drive shaft. A set of metallic fins 66 are machined in a radial orientation on the outer face of the housing portion 14*c*. The fins enhance heat transfer principally from the pump 30 to an air flow produced by the fan. The fins 66 also stiffen the housing 14*c* to resist deformation due to the pressure differential across the housing (at steady state operation, a differential of a few milliTorr to one atmosphere). Deformation is highly undesirable since it varies the scroll wall clearance spacings within the scroll pump 30 which can increase both gas leakage and blade wear. Fins 67 (FIG. 3) on the housing portion 14*b* serve the same function as fins 66. The air flow 61 passes around the outer periphery of the housing 14*b*, 14*c* guided by a plastic cowl 68 secured over the front or outboard end of the pump 10 by screws 70. It flows over the fins 67 and exits to atmosphere through openings 72.

Returning to FIG. 2, a set of three synchronization crank assemblies 74 are disposed in a circular array between the outer periphery of the plate 22 and the outer, inwardly facing surface of the housing part 14*b*. Each synchronization crank assembly consists of a needle bearing 74*c*, two ball bearings 74d and a small crank 74*e*. The ball bearings 74*d* can be of the type sold by Fafnir under its Model No. 36KDD. The needle bearing 74*c* can be of the type sold by INA under its Model No. NK15/12TN. All bearings are grease lubricated with a low vapor pressure grease, such as DuPont Krytox 240AC brand. The bearing assemblies 74 function as idler cranks. They allow a movement of the plate 22 with respect to the housing 14*b*, but they constrain the plate against a rotation about the axis 46*b*. The allowed motion is a circular orbiting or revolving with an orbital radius r. Additionally, o-rings 74*f* allow the needle bearings 74*c* to move radially a small amount to compensate for thermal expansion of plate 22 with respect to housing 14*b*.

A principal feature of the present invention is purge gas flows 78 and 80 for the synchronization cranks 74 and the main bearings 48, 50, respectively. The gas flow 78, shown schematically originating at a gas source 79, is applied to one of the bearing assemblies 74 via a radial port 82 in the housing portion 14*b*. This flow bathes the ball bearings 74*d* held in the housing portion 14*b*. A portion of the gas flow is then carried by passage 74*b* to the bearings 74*c* held in the plate 22. The purge gas flow from the crank 74 is then discharged via port 84 in the plate 22 to the region 29 of between stages I and II. The purge gas flow thus flows over the bearings in the assembly 74 and discharges to an intermediate pressure region, typically 100 milliTorr, characteristic of this region. It is significant that it is not discharged to the pump inlet region 14*a*, 18*a* where it would contribute gas to the volume being pumped out. The synchronization crank assemblies can be protected from corrosive gases without adversely affecting pump performance. A typical purge flow rate is 0.01 to 1.0 lpm. The purge gas can be any gas which does not react with the pump parts or with the fluids being pumped. For reasons of cost and availability, dry nitrogen gas is preferred. Gases such as air or argon are also known and can be used.

The two synchronization crank assemblies 74 (shown in FIG. 4), that are not directly in line with port 82, are supplied the purge gas 78 via a radial passage 86 that feeds a circular header 88 formed in a cover plate 112. The header 88 directs the purge gas 78 to two other radial passages 86 that each feed the purge gas to and through the other two bearing assemblies 74. All of the bearing assemblies 74 discharge the purge gas to the inter-stage region of the pump which during operation is at an intermediate pressure.

Referring to FIG. 3, a second purge gas flow 80 is fed from the supply 79 to a feed port 90 formed in a housing 14*c*. The port 90 directs the purge gas flow via an axial slot 90*a* to the main bearings 48, 50, exiting via an axial passage 93 (FIG. 2), a radial port 94, and spring-loaded check valve 96, to a radial outlet passage 98 open at its outer end to the cooling air flow passage between the cowling 68 and the housing 14*b*, 14*c*. The check valve 96 can be similar in construction to check valve 15. Alternatively, the exiting purge gas can be routed, via external plumbing (not shown), to the exhaust 16*b*. In this manner, toxic or corrosive process gases can be prevented from entering the atmosphere.

The pump 10 is readily assembled and disassembled for replacement of defective or worn parts. Removal of screws (not shown) allows the pump 10 as a whole to be removed from a mounting frame 102 using an axial movement to disengage the motor-to-pump coupling 44.

A screw 104 is then accessible. It threads into an end of the drive shaft 46 to secure the counterweight assembly 64. A pin 106 aligns the sub-assemblies 64*a* and 64*b* exactly 180° apart. A keyway 108 aligns the counterweights with the shaft 46, and therefore with the eccentric 46*a*. Bolts 105 sandwich and secure the fan blades and counterweight subassemblies.

At the outboard or front side of the pump, screws 110 secure the cover plate 112 sealed to the outer surface of the housing portion 14*b* by a pair of o-rings 114 held in suitable grooves that straddle the purge gas header 88 concentrically. Removal of the plate 112 gives access to snap ring 122 which secures a cover 118. Axial withdrawal of this cover in turn gives access to a set of screws 120 in a locking nut 121 that is used to adjust the axial position of the plate 22 on drive shaft eccentric 46*a*. This nut is preferably a Spieth brand MSR 17×32. At final assembly, the nut is adjusted to position the plate 22 in the middle between housing portions 14*b* and 14*c*. When the nut 121 is in its correct position, the screws 120 are tightened to self-clamp the nut 121 to the threads on eccentric 46*a*. Static vacuum seals 116 prevent atmospheric pressure gas from leaking to the intake 14 past the cover 118 and plug 117.

As is well known for roughing pumps, in general, port 91 and cross-hole 92 (FIG. 3) constitute an "air stripping" port.

Air or other gas can be introduced to help purge and/or evaporate water or other condensed liquids from region 30*b* via port 14*d* (FIG. 5).

By way of illustration, but not of limitation, for a dry vacuum pump with a displacement capacity of 10 CFM (about 280 lpm) producing a steady state vacuum of less than 2 milliTorr in about 10 minutes the scroll plate 22 has a diameter of 9.0 inches, a thickness, exclusive of the blades, of ¼ inch, and is formed of any suitable structure material such as machined aluminum. After the scrolls are milled to close tolerances they are hardcoated to improve the surface properties of the aluminum. The first stage scroll blades are in three nested pairs and have a height of about 21/32 inch and a thickness of 0.157 inch. The single pair of second stage blades have a height of about ⅝ inch and a thickness of 0.157 inch. The minimum blade-to-blade clearance in the first and second stages is 0.004 inch. The first stage has roughly three times the volumetric displacement rate of the second stage. The first stage blades have the number and configuration shown in FIGS. 2–4. The motor 40 rotates at about 1740 rpm and consumes about 350 watts steady state.

A significant aspect of this invention is that a high displacement rate and low back leakage can be attained with a comparatively small crank radius, e.g., 0.157 inch in the illustration given above. The crank radius is preferably less than twice the thickness of blade 31 or 32. As noted above, heretofore such a small crank radius was considered incompatible with a high displacement rate since it translated into a correspondingly small volume in the scroll pump pockets. The nested, two or more blade pairs of the first stage pump 18 with the radial and angular configuration and dimensions described above, produces a high displacement rate with only this small crank radius—preferably on the order of magnitude of the blade thickness. As illustrated and described, the presently preferred embodiment has three nested blade pairs.

The small crank radius of this invention has a major advantage in that it reduces the velocity of the tip and other seals (since velocity is proportional to the crank radius). This in turn reduces seal wear which results in a longer maintenance interval and less seal wear contamination. A regular maintenance interval of 9,000 hours is anticipated. The small crank radius also reduces the radial crank force, which it is also proportional to the radius, as well as reducing frictional heating and steady state power consumption. Further, because the first and second stage pumps orbit on the same radius, a small crank radius allows more revolutions of the second stage blade pair which produces more serially spaced clearance seals and radially spaced tip seals reducing back leakage, whether past the clearance seals or the tip seals.

As with the axial height calculation, there is no one correct value for the crank radius. The value can be determined empirically from the end performance objectives and the optimization of one or more of the parameters noted above, e.g., wear reduction, power consumption, back leakage control, initial cost reduction, etc.

Figure 6:
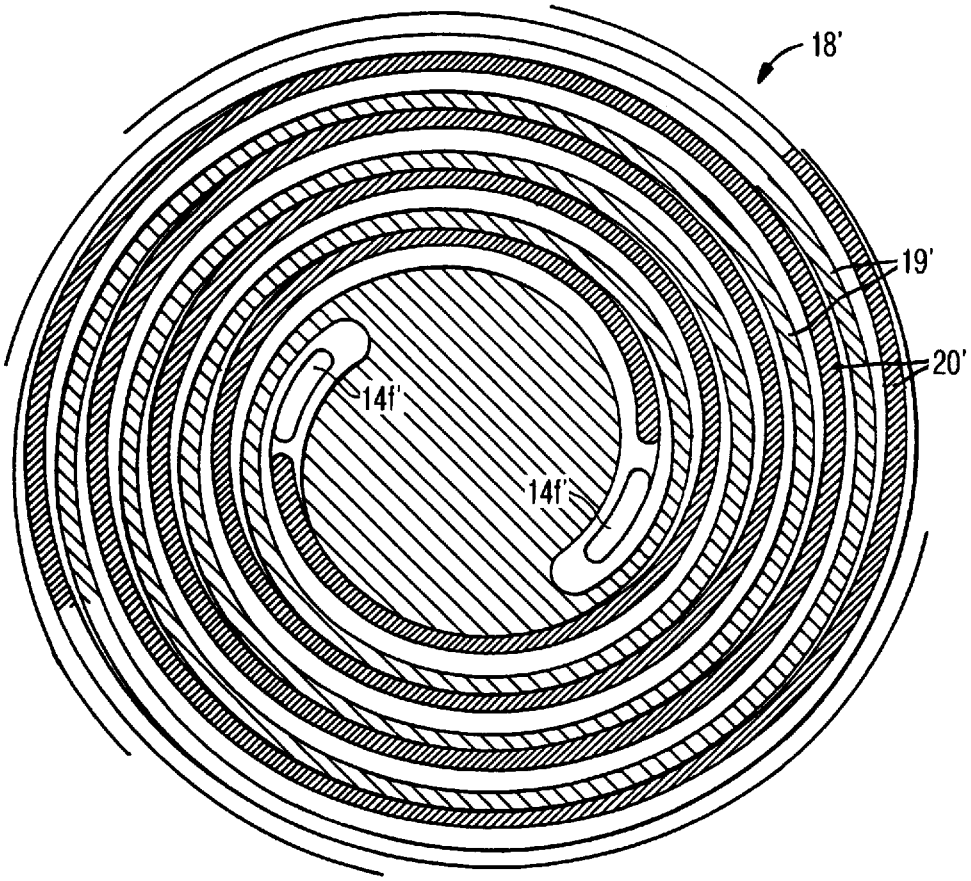
FIGS. 6 and 7 are simplified views in side elevation corresponding to FIGS. 4 and 5, respectively, of alternative first and second stage scroll set configurations for use in extremely low pressure applications.

FIGS. 6 and 7 show an alternative construction for the first and second stage pumps 18', 30' (like parts in this embodiment being identified with the same reference numbers as used to describe the FIGS. 1–5 embodiment, but denoted with a prime). The first stage pump 18' uses only two nested blade pairs 19', 20', that each extend angularly for about two revolutions (720°). There are, correspondingly, two intake ports 14*f'* at the region 18*a'*, and two possible outlet sites at region 18*b'*. The crank radius is also preferably reduced with respect to the FIGS. 1–5 embodiment, e.g., in the foregoing example, from 0.157 inch to 0.100 inch, about ⅓.

This construction produces two pockets, in series, between adjacent blades. Thus, it requires two revolutions, not one, to transport a given pocket of a working gas through the first stage pump. However, the lengthened flow path with plural pockets and an intermediate clearance seal are significantly more effective in controlling backflow. FIG. 7 shows the corresponding single pair blade set 31', 32' of the second stage pump 30'. It produces five pockets in series. The FIGS. 6 and 7 embodiment sacrifices displacement rate (about 100 lpm as compared to about 280 lpm in the foregoing example) in favor of being able to produce a lower ultimate base pressure in the system being pumped. More specifically, with this configuration used in a pump with the dimensions and operating parameters given in the foregoing example (except the aforementioned reduction in crank radius), the pump 10' can produce extremely low ultimate base pressures, typically less than 0.5 milliTorr. This pump can be used in helium leak detection and the like, and may be able to eliminate the use of a turbo pump in combination with the scroll pump for maintaining an acceptable vacuum within the spectrometer tube.

There has been described a scroll-type, fluid handling apparatus which operates with a high displacement rate, yet which when operated as a vacuum pump can support a base pressure of less than 2 milliTorr, and in at least one embodiment, below 0.5 milliTorr. The pump can operate dry, with no liquid lubricant or coolant interacting with the fluid. It can produce these results with a comparatively low power consumption and with a design that operates with long intervals between routine maintenance, particularly tip seal and bearing replacement. It controls the corrosion and premature failure of interior bearings and it requires only known types of bearings and cranks with no special seals, or in the case of idler cranks, with only shields for the lubricants.

While the invention has been described with reference to its preferred embodiments, it will be understood that various modifications and alterations will occur to those skilled in the art from the foregoing detailed description and the accompanying drawings. For example, the invention can operate with plural orbiting plates, one for each stage, and with a different number of nested scrolls, e.g., five, and angular extent of blades (e.g., 340°–380° for one revolution, or 680°–760° for two revolutions) in the first stage, but with certain trade-offs. Similarly, while the preferred embodiment uses air cooling exclusively, this invention can be used with liquid lubricants and coolants, although with the attendant contamination problems noted above, as well as the cost of providing systems, seals, and the like to support liquid cooling and/or lubricants.

Further, while the invention has been described with a common central eccentric drive, it is possible to utilize the features and advantages of this invention with other known eccentric drives such as a driven peripheral crank or peripheral bearings that bear the axial loading, e.g., those described in U.S. Pat. No. 4,259,043. The synchronization crank assemblies 74 could use roller bearings or assume a variety of other known forms. Similarly, the main bearings assemblies 48, 50 can be non-angular, albeit with a sacrifice of the moment carrying capability of the bearings 48, 50 as described above.

The gas purge system can, of course, be implemented differently. The entry ports can have different locations.

Separate entry ports can be used for each bearing. The flow at the bearings can be otherwise routed. Various passages or conduit arrangements can be devised to discharge the gas to a low pressure region, and then evacuate it from the pump. These and other modifications are intended to fall within the scope of the appended claims.

What is claimed is:

1. A high volumetric displacement rate fluid handling apparatus comprising:

a housing with an inlet and an outlet for the fluid;

a first scroll set of at least two nested pair of fixed and movable spiral blades mounted in said housing, said first scroll set having an inlet and an outlet in fluid communication with said housing;

a plate mounted within said housing that carries said movable blades;

an eccentric drive operatively connected to said plate and said movable blades that causes said movable blades to orbit said fixed blades and thereby interact with the fluid in inter-blade pockets;

said at least two pairs of fixed and movable blades being in a nested array and each extending angularly over about two revolutions to produce two inter-blade pockets in series per pair of said fixed and movable blades, one of said pockets closing in each cycle of operation;

a second scroll set mounted in said housing formed of at least one pair of fixed and movable spiral blades that both extend angularly for multiple revolutions, said eccentric drive also propelling said movable spiral blades of said second stage scroll set to move in an orbital motion that creates a series of inter-blade pockets moving toward said housing outlet, said second scroll set having an inlet and an outlet; and a fluid connection between said outlet of said first scroll set to said inlet of said second scroll set, said second scroll set discharging the fluid from said second scroll set outlet to said housing outlet, said first scroll set having a volumetric displacement rate at its inlet that is greater than the volumetric displacement rate of said second scroll set.

2. The high displacement rate fluid handling apparatus of claim 1, wherein there are two of said blade pairs of said first scroll set.

3. The high displacement rate fluid handling apparatus of claim 1, wherein said eccentric drive includes a plurality of cranks each rotatable in bearings and mounted between said plate and said housing, and further comprising a system that flows a purge gas over at least one of said crank bearings and then discharges the purge gas to said fluid connection between said first and second scroll sets.

4. The high displacement rate fluid handling apparatus of claim 3, wherein said cranks have an internal passage for a flow of said purge gas.

5. The high displacement rate fluid handling apparatus of claim 1, wherein said eccentric drive includes a main bearing that receives the principal portion of the axial load due to pressure differences created by the operation of the fluid handling apparatus.

6. The high displacement rate fluid handling apparatus of claim 5 and wherein said main bearing is a pair of angular contact bearings arranged in an axial alignment with a back-to-back orientation.

7. The high displacement rate fluid handling apparatus of claim 5, wherein a purge gas flow system includes passages that direct the purge gas over said main bearing and then discharges it to atmospheric pressure.

* * * * *